US009140495B2

(12) United States Patent
Ferrell et al.

(10) Patent No.: US 9,140,495 B2
(45) Date of Patent: Sep. 22, 2015

(54) ROTARY BIOMASS DRYER

(71) Applicant: Enginuity Worldwide, LLC, Columbia, MO (US)

(72) Inventors: Allen R. Ferrell, White Salmon, WA (US); David N. Smith, Appleton, WA (US)

(73) Assignee: ENGINUITY WORLDWIDE, LLC, Columbia, MO (US)

( * ) Notice: Subject to any disclaimer, the term of this patent is extended or adjusted under 35 U.S.C. 154(b) by 119 days.

(21) Appl. No.: 14/161,892

(22) Filed: Jan. 23, 2014

(65) Prior Publication Data

US 2014/0137421 A1 May 22, 2014

Related U.S. Application Data

(62) Division of application No. 12/197,513, filed on Aug. 25, 2008, now Pat. No. 8,667,706.

(51) Int. Cl.

| | |
|---|---|
| ***F26B 21/00*** | (2006.01) |
| ***F26B 20/00*** | (2006.01) |
| ***B30B 11/22*** | (2006.01) |
| ***F26B 5/14*** | (2006.01) |

(52) U.S. Cl.

CPC ..... *F26B 20/00* (2013.01); *B30B 11/225* (2013.01); *F26B 5/14* (2013.01)

(58) Field of Classification Search

CPC ..... F26B 15/00; F26B 15/26; F26B 19/00; F26B 21/00; F26B 21/06; C01B 7/00; C01B 49/02; Y02E 50/00; Y02E 50/15

USPC ..... 34/60, 167, 172; 201/32, 36; 202/84, 202/118; 110/234, 267

See application file for complete search history.

(56) References Cited

U.S. PATENT DOCUMENTS

| | | | | |
|---|---|---|---|---|
| 4,759,300 | A | 7/1988 | Hansen et al. | |
| 5,705,035 | A | 1/1998 | Avetisian et al. | |
| 6,209,223 | B1 * | 4/2001 | Dinh | 34/86 |
| 6,398,921 | B1 | 6/2002 | Moraski | |
| 7,144,558 | B2 | 12/2006 | Smith et al. | |
| 7,987,613 | B2 * | 8/2011 | Ness et al. | 34/138 |
| 8,667,706 | B2 * | 3/2014 | Smith et al. | 34/381 |

(Continued)

FOREIGN PATENT DOCUMENTS

| | | | | |
|---|---|---|---|---|
| DE | 102008029735 | * 12/2009 | | F23G 5/04 |
| EP | 0033397 | * 8/1981 | | |
| WO | WO 2007087827 A1 | * 8/2007 | | C10L 5/40 |

*Primary Examiner* — Stephen M Gravini

(74) *Attorney, Agent, or Firm* — Brinks Gilson & Lione

(57) ABSTRACT

A biomass drying system includes a rotary biomass dryer that includes a helically threaded auger shaft rotatably driven by a prime mover, such as an electric motor. No external source of heat is required to dry a wet biomass material that is supplied to an input of the biomass dryer. Instead, the helical threads on the shaft have a variable width, designed to gradually increase the compression applied as the biomass material is advanced through a generally cylindrical bore in the biomass dryer. A variable compression nozzle is disposed at a distal end of the bore and can be adjusted to achieve a desired level of a parameter such as the moisture content of the dried biomass material produced by the system. The variable compression nozzle, which can be automatically controlled, includes longitudinally extending segments that are forced radially inwardly to increase the compression force applied to the biomass material.

20 Claims, 8 Drawing Sheets

(56) References Cited

U.S. PATENT DOCUMENTS

| | | | | |
|---|---|---|---|---|
| 8,832,964 | B2 * | 9/2014 | Foxen | 34/396 |
| 2008/0028634 | A1 * | 2/2008 | Leahy | 34/480 |
| 2009/0000184 | A1 * | 1/2009 | Garwood | 44/307 |
| 2010/0043246 | A1 * | 2/2010 | Smith et al. | 34/147 |
| 2011/0175358 | A1 * | 7/2011 | Langson | 290/52 |
| 2015/0041574 | A1 * | 2/2015 | Anderson | 241/17 |

* cited by examiner

ROTARY BIOMASS DRYER

CROSS REFERENCE TO RELATED APPLICATIONS

The present patent disclosure is a divisional of application Ser. No. 12/197,513 entitled "Rotary Biomass Dryer", filed Aug. 25, 2008, the entire disclosure of which is hereby incorporated by reference.

FIELD

This invention relates generally to the field of biomass dryers. More specifically, this invention pertains to an apparatus for reducing a moisture content of a biomass material that is relatively wet.

BACKGROUND

Traditional biomass particulate dryers employ external heat sources, such as gas-fired burners, to heat biomass particulates within a metal drum to a temperature sufficiently high to evaporate water from the particles. The water vapor is drawn out of the drum as steam. To ensure that the particulate biomass material is continually exposed to the heat, such dryers can include paddles or a helical screw auger that continuously stirs the biomass within the drum. Alternatively, the drum may be rotated to agitate the particulates. Using such systems, it is possible to dry wet sawdust from a moisture content of up to 90%, achieving a moisture content as low as about 10%. However, considerable fuel is burned to provide the heat for drying the particulate biomass in a conventional drum dryer, and more energy is required to rotate the drum or the internal agitating mechanism. Unless the heat applied is waste heat from some other productive process, the drying of particulate biomass materials can be a relatively expensive process, particularly due to the increasing cost of fossil fuels.

Conventional dryers implement what can be characterized as a batch drying process. The drum of a conventional dryer is typically loaded with a charge of wet biomass particulate material and the heat from the external source is applied until the desired moisture content of the material being dried is achieved. One type of biomass material that must be dried is wet sawdust, which may be produced at a lumber mill as logs are sawn into lumber, rail ties, or some other type of wood product. Lumber mills process logs on a continuous basis while in operation, so the sawdust that is a byproduct of the sawing operation is produced continually. Ideally, it would be desirable to dry the sawdust on a continuous basis so that the resulting dried wood particles used to make wood pellet fuel and animal bedding, pressed wood logs, and other products is also being produced on a continuous basis. Accordingly, it will be evident that it would be more desirable to provide a biomass drying system that can dry biomass particulates on a continuous basis, producing an output stream of dried wood particles for further product production. The speed and efficiency of the drying process would thus be greatly enhanced by providing a continuous feed process biomass dryer.

Another characteristic of conventional biomass drum dryers is that they are typically installed as fixed systems and are sized to handle batches of biomass material of a desired volume. Accordingly, for applications in which there is a need for a portable biomass dryer, the conventional systems are typically not practical. Also, the amount of biomass material that must be processed can sometimes be variable. For example, if the source of biomass material produces volumes of the wet material that vary substantially, it can be even less efficient to run a relatively smaller charge of the material through a conventional externally heated drum dryer when the volume to be processed is smaller than the design volume of the drum. Thus, another benefit of a continuous processing biomass dryer would be that the processing might simply be halted once the available mass of biomass material has been dried.

Furthermore, drum dryers are not suitable for drying some of the waste streams produced by various industries. Specifically, waste materials having a characteristic small particulate size cannot normally be processed in drum dryers. These materials include sludge from waste water treatment plants, spent grains from ethanol productions facilities, wet waste paper from paper mills, waste pulp, and a host of other similar materials. It would therefore be desirable to provide a dryer that can be employed to dry such materials, so that they can be used as alternative fuels instead of being put in land fill or burned wet with the added heat provided by a secondary fuel source. Because a suitable dryer is not available, many of the producers of these waste streams are putting them in land fills at a substantial expense to themselves, and causing an adverse impact on the environment.

Since the conventional biomass dryers are unable to overcome the problems noted above, it would clearly be desirable to develop a biomass dryer that operates in a substantially different manner that is able to provide continuous batch processing and is more portable. While the amount of biomass material that is to be processed is less of an issue in a continuous processing system, it would still be desirable to provide a continuous process biomass dryer that can readily be sized for almost any desired throughput rate, so that the processing capability can be generally matched to the maximum required throughput rate. The biomass dryer should also be generally portable, so that it can readily be moved to a site where there is a need for the dryer.

SUMMARY

Accordingly, a novel approach has been developed for reducing a moisture content of a biomass material that is relatively wet. One aspect of this new approach is directed to an exemplary apparatus that includes a prime mover, such as an electric motor or fuel powered combustion engine, while other types of prime movers can alternatively also be used. The apparatus further includes an elongate housing extending between a proximal end and a distal end and having an inlet disposed adjacent to the proximal end for receiving the relatively wet biomass material. An outlet through which the biomass material passes after being dried to a substantially lower moisture content is disposed adjacent to the distal end. A generally helical screw shaft is disposed within the elongate housing and is drivingly coupled to the prime mover so as to be rotated thereby about a longitudinal axis of the shaft. The direction of rotation of the shaft is selected so that helical screw threads formed on the shaft force the biomass material entering through the inlet to move through the housing, toward the distal end, and then out through the outlet of the housing. The biomass material is compressed as it is moved through the elongate housing forcing moisture from the wet biomass material. In addition, friction resulting from the compression and movement of the biomass material through the housing heats the biomass material sufficiently to drive out most of the moisture remaining in the biomass material, thereby substantially drying it.

The elongate housing includes an adjustable section disposed adjacent to the distal end. This adjustable section includes a plurality of adjacent longitudinally extending segments that are disposed circumferentially around the helical screw shaft and which together define a general cylindrical shape bore with an internal diameter that can be adjusted at the distal end of the elongate housing. The annular clearance between an interior surface of each segment and the helical screw shaft is adjusted by forcing the segments to move radially inwardly or outwardly at the distal end of the housing, thereby varying the internal diameter of the cylindrical shape formed by the segments. Thus, the extent to which the biomass material is compressed as it moves through the adjustable section is variable to achieve a desired moisture content in the biomass material exiting through the outlet.

The adjustable section includes a jackscrew that extends between a fixed member and a rotatable ring that extends circumferentially around the segments. The rotatable ring includes a plurality of spaced-apart rotatable wheels that roll on ramps to apply a radial force against the segments that varies as the wheels roll up or down the ramps, depending on a direction in which the jackscrew is rotated. The varying radial force alters the internal diameter of the cylindrical shape formed by the segments, which varies the compression of the biomass material.

In another exemplary embodiment, each of the segments includes tabs extending radially outward and running longitudinally along opposite edges of the segment, adjacent to distal ends of the segment. Threaded fasteners couple the tabs on adjacent sections together and are tightened or loosened to achieve a desired radial compression of the plurality of segments, to variably adjust an internal diameter of a cylindrical bore shape defined by the segments. This embodiment further includes helical springs on the threaded fasteners to provide a biasing force that radially compresses the segments more when the threaded fasteners are tightened and releases the radial compression as the threaded fasteners are loosened.

The helical screw shaft can include a distal portion having threads that are finer and more closely spaced than threads provided on a proximal portion of the shaft. Also, the helical screw shaft can include helical threads of varying width over at least a portion of its length, and/or helical threads of differing densities along its length.

In one exemplary embodiment, the helical screw shaft is directly coupled to a drive shaft of the prime mover. The prime mover and elongate housing can be mounted on a portable base to enable the apparatus to be portable and readily movable to a site where the apparatus is to be used for drying the wet biomass material.

Means can be provided for adjusting an extent to which the biomass material is compressed before it exits through the outlet, in consideration of at least one characteristic, such as an initial moisture content of the wet biomass material that enters the inlet of the elongate housing; a particulates size of the wet biomass material entering the inlet of the elongate housing; a desired moisture content of the biomass material exiting the outlet of the elongate housing; one or more characteristics of a specific type of the wet biomass material that is to be dried with the apparatus; and, a desired temperature range for the biomass material exiting the outlet of the elongate housing. The means for adjusting can be disposed adjacent to the distal end of the elongate housing and can include a plurality of longitudinally extending segments that are circumferentially disposed around the helical screw shaft. The means for adjusting can further include means for varying a radial force applied against the segments so as to vary a gap defined between the segments and the helical screw shaft.

The inlet can be configured and the prime mover operated so as to enable a continuous processing of a stream of the wet biomass material, so long as the wet biomass material is continually supplied through the input.

Another aspect of this novel approach is directed to a method for drying a wet biomass material to reduce its moisture content. The steps of the method are generally consistent with the functions implemented by the components of the apparatus discussed above.

The present biomass dryer has been tested for drying waste streams comprising many of the small particulate materials that cannot be dried in conventional drum dryers and was found to be successful at reducing the moisture content to a level sufficiently low to enable these materials to be used as a high quality commercial or domestic fuel. The costs involved in drying small particulate materials with the present technology has been demonstrated to be significantly less than those associated with traditional drying methods.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

DESCRIPTION

Figure 1:
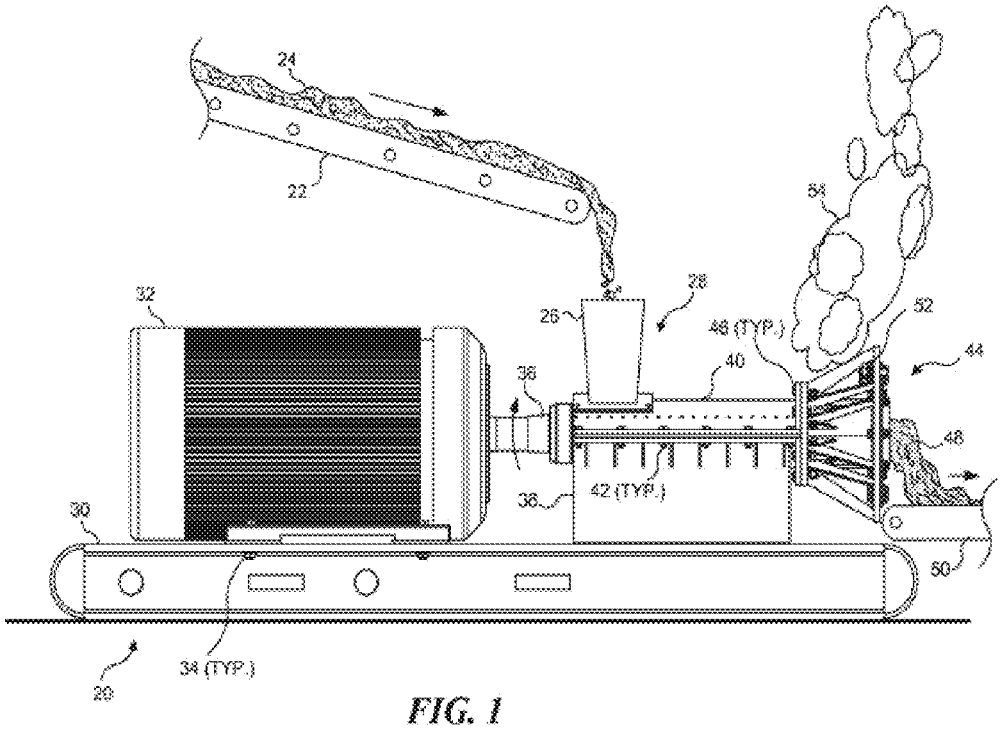
FIG. 1 is a side elevational view of an exemplary system for drying a wet biomass material and illustrates portions of a conveyor that delivers the wet biomass material into an input and of a conveyor that carries away the biomass material after it has been dried by an exemplary rotary biomass dryer.
Figure 2:
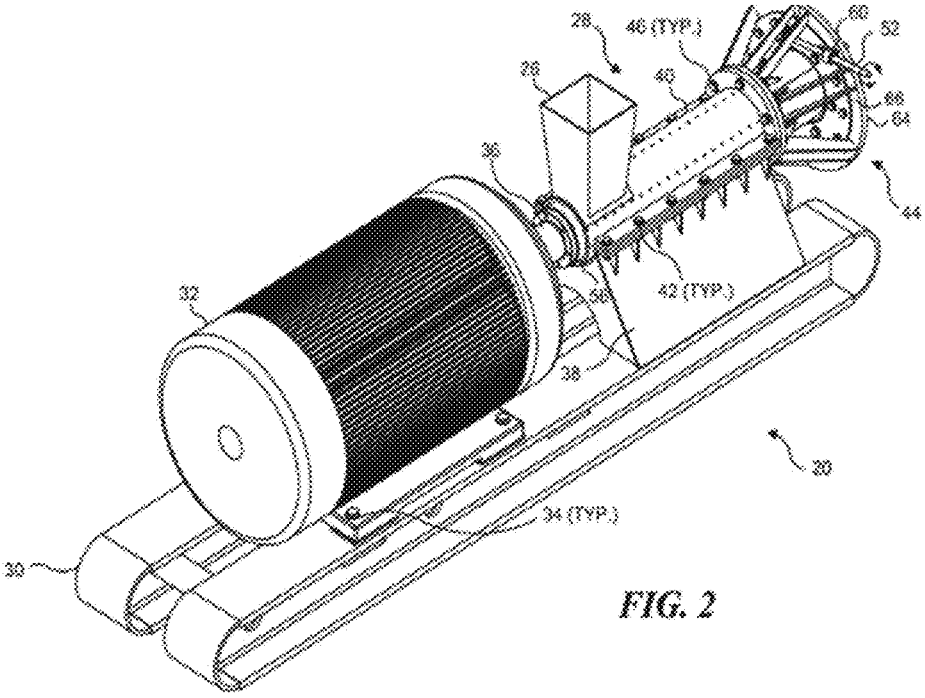
FIG. 2 is an isometric view of the rotary biomass dryer as shown in FIG. 1.

Figures and Disclosed Embodiments are not Limiting

Exemplary embodiments are illustrated in referenced Figures of the drawings. It is intended that the embodiments and Figures disclosed herein are to be considered illustrative rather than restrictive. No limitation on the scope of the technology and of the claims that follow is to be imputed to the examples shown in the drawings and discussed herein.

Exemplary Biomass Drying System

FIG. 1 illustrates an exemplary biomass drying system 20 in which a conveyor 22 is used to supply a wet biomass material 24 to an input hopper 26 of a rotary biomass dryer 28. In this exemplary system, a base frame 30 is employed to support a prime mover 32, which in this example is an electric motor, as well as rotary biomass dryer 28. A plurality of threaded fasteners 34 are used to mount the prime mover to the base frame. The base frame is strong, but relatively lightweight and is sufficiently portable so that it can readily be transported to a site where there is a need for drying wet biomass material. For example, although not limited to this exemplary application, it is contemplated that the biomass drying system can be used to dry wet sawdust produced by a lumber mill. The biomass drying system can be scaled up or down in size and capacity to handle various production rates for drying wet biomass material. Thus, a smaller biomass drying system might be transported to a site where a portable sawmill is being used, to enable drying of the sawdust produced by the sawmill.

While the example of the biomass drying system shown in FIG. 1 includes an electric motor for prime mover 32, it will be apparent that other types of prime movers might instead be used, such as an internal combustion engine (gas or diesel, or other fuel), or other types of fuel burning engines or power sources. For use where an electric power source is not available, the prime mover can thus be selected to burn available fuel at the site, and might, for example, burn sawdust to produce steam, to enable a steam engine to serve as the prime mover.

FIGS. 2-7 illustrate further details and views of exemplary rotary biomass dryer 28, while FIGS. 8-12 illustrate different views and details of a variable compression nozzle 44, which is used for final compression and heating of the biomass material and which can be adjusted to achieve a desired parameter or characteristic in regard to the drier biomass material that is produced as a result of compression and frictional heating of the wet biomass material passing through the rotary biomass dryer.

Figure 3:
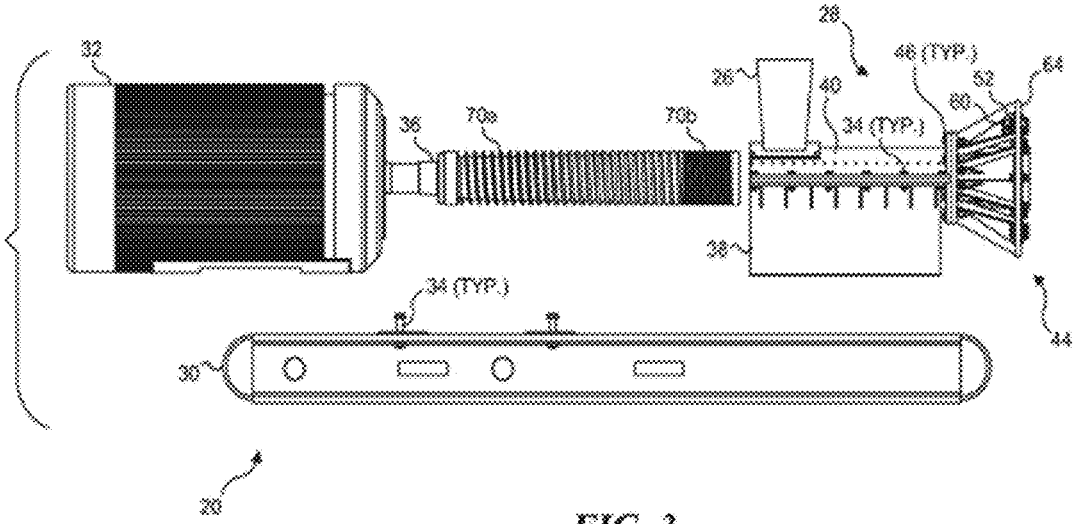
FIG. 3 is an exploded view of the rotary biomass dryer of FIG. 1, showing further details of a helically threaded shaft that is used to move the biomass material through the dryer.
Figure 4:
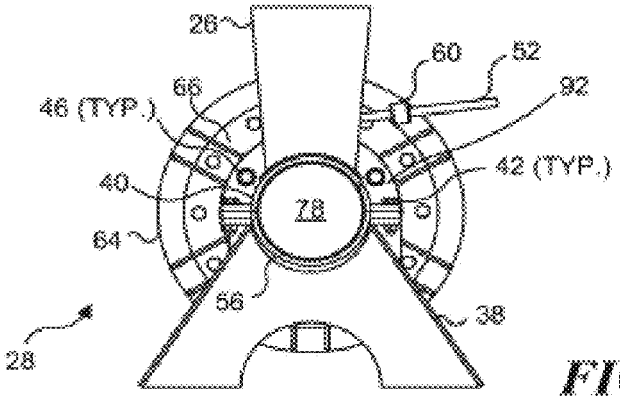
FIG. 4 is an end elevational view of the rotary biomass dryer of FIG. 1, with the supporting base, prime mover, and helically threaded shaft removed.
Figure 5:
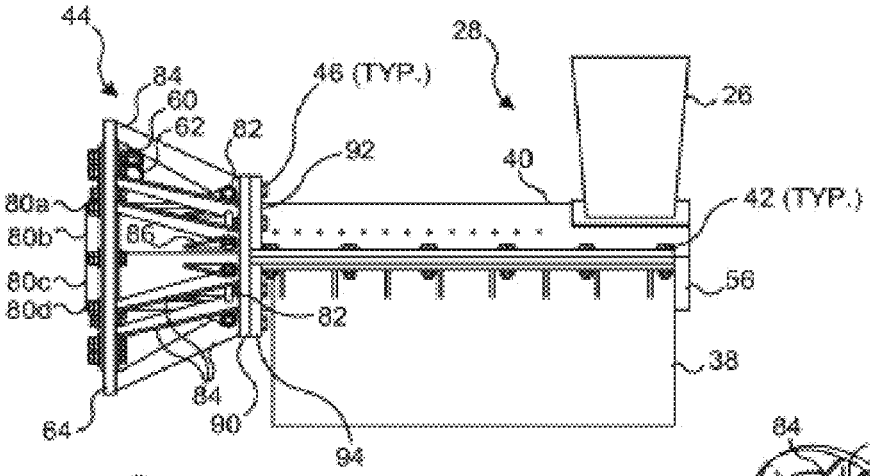
FIG. 5 is a side elevational view of the rotary biomass dryer, with the same components removed as in FIG. 4.
Figure 6:
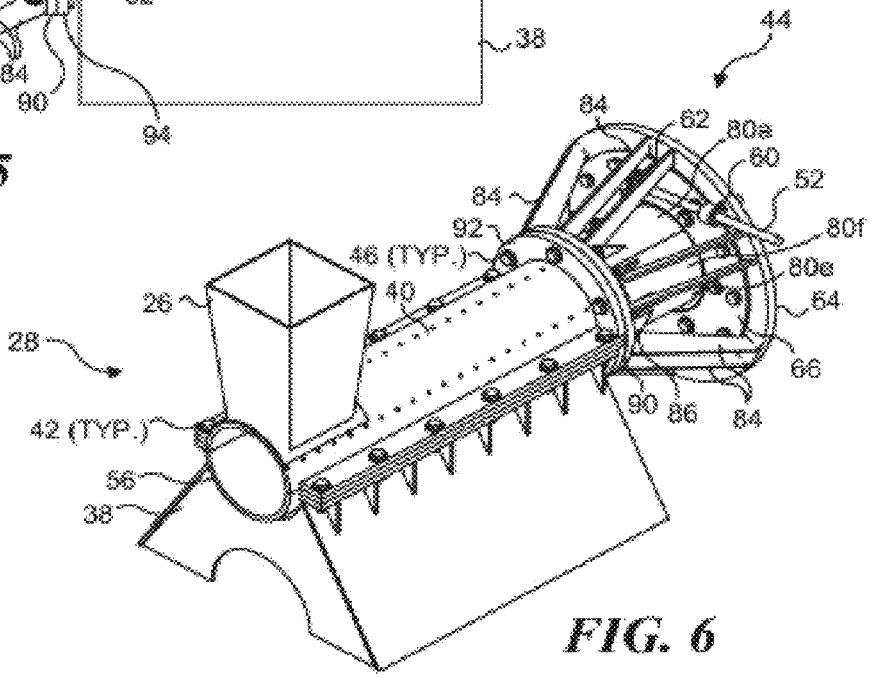
FIG. 6 is an isometric view of the rotary biomass dryer, with the same components removed, as in FIG. 4.

As shown more fully in the exploded view of FIG. 3, an auger shaft 36 having variable width helical threads 70*a* on a proximal portion of its length and a section of more closely spaced-apart helical threads 70*b* (i.e., a section of the auger shaft having a higher density of threads, or more threads per inch) on its distal end. The auger shaft is rotatably driven by prime mover 32. Helical threads 70*a* of auger shaft 36 normally extend through the portion of rotary biomass dryer 28 that includes a lower housing 38 and an upper housing 40. A bore through the housing is defined by upper housing 40 and a lower bore portion 56. The upper and lower housing (including lower bore portion 56) are coupled together around the auger shaft by a plurality of threaded fasteners 42. Variable compression nozzle 44 is coupled to the outlet of the upper and lower housing, using threaded fasteners 46, so that the section of the auger shaft with the more closely spaced-apart helical threads 70*b* are normally disposed within the portion of the bore defined by the variable compression nozzle.

Figure 7:
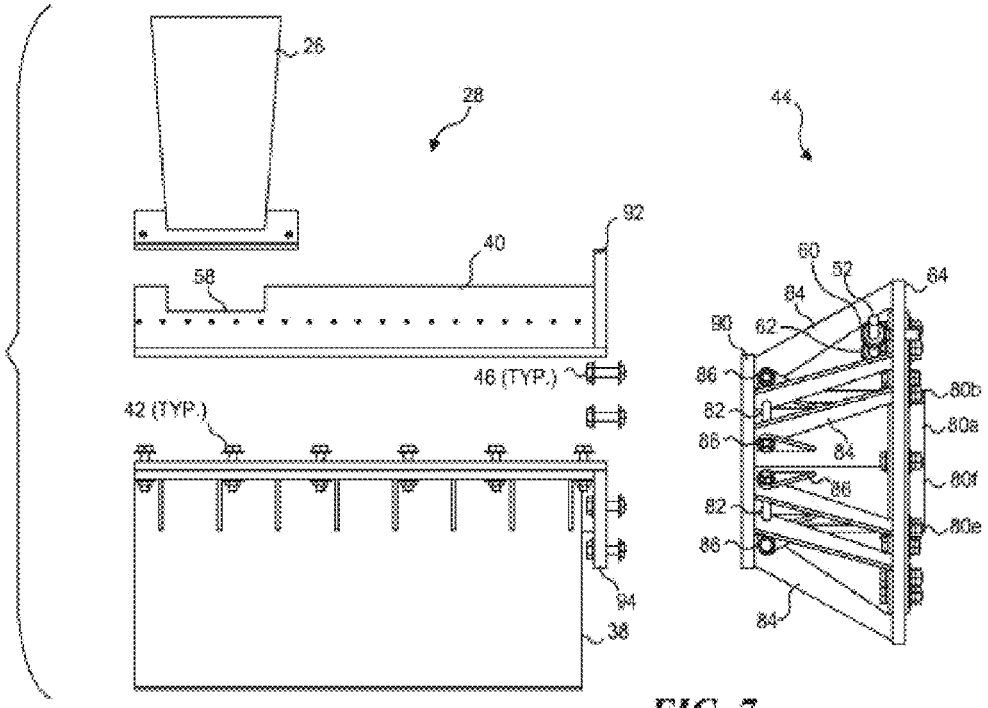
FIG. 7 is an exploded side elevational view of the rotary biomass dryer, from the opposite as that shown in FIG. 5.
Figure 8:
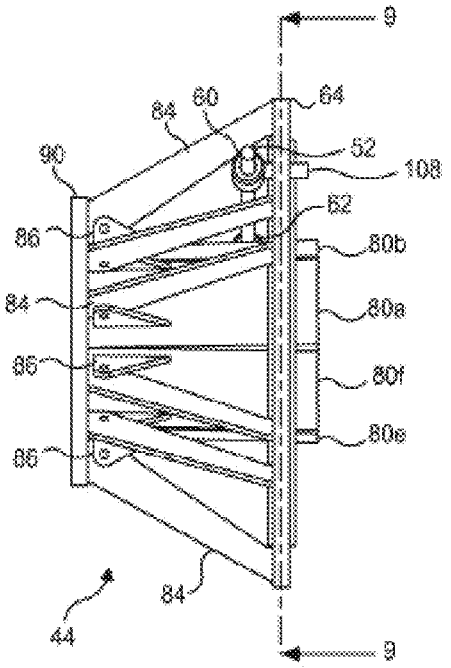
FIG. 8 illustrates a variable compression nozzle for the exemplary rotary biomass dryer.

The wet biomass material that enters input hopper 26 falls through an opening 58 that is formed in upper housing 40 (FIG. 7). This material is conveyed through the rotary biomass dryer by the helical threads on auger shaft 36 and after passing through variable compression nozzle 44, passes out through the outlet of the dryer as relatively drier biomass material 48. As the helical threads force the wet biomass material entering input hopper 26 and opening 58 to advance through the bore of the rotary biomass dryer, the increasing width of the helical threads in the section of the auger shaft having variable width helical threads 70*a* both compresses the particles comprising the biomass material and heats the biomass material due to friction between the material and both the threads and the interior of the bore.

It must be emphasized that it is not necessary to provide heat from an external source to achieve the desired drying of the biomass material. The compression and heat of friction produced in the rotary biomass dryer reduce the moisture content of the biomass material passing through the outlet by 30% to 40%. At least some of the moisture included in the wet biomass material leaves orifices formed in the housing of the rotary biomass dryer as liquid water, while much of the moisture is evaporated, forming clouds of steam 54, as shown in FIG. 1, due to the heating that occurs as a result of the friction as the biomass material is advanced through the bore of the dryer by the auger shaft. When exiting the rotary biomass dryer, the temperature of the dry biomass material can be in the range from about 212° F. to about 250° F. The dry biomass material is carried away on a conveyor 50 in exemplary biomass drying system 20, which is shown in FIG. 1.

A compression adjustor 52 can be rotated or otherwise moved so as to adjust the level of compression applied by variable compression nozzle 44, and to thus achieve a desired parameter in dry biomass material 48. For example, it may be desirable to control the moisture content of the dry biomass material to a specific level, so that the dry material can be more readily pressed into pellets for pellet wood stove fuel, or pellets for livestock bedding, or into pressed logs that can be burned in a fireplace. Each of these uses may require a different level of moisture content in the dry biomass material being produced by the rotary biomass dryer. In other applications in which the biomass material is not wood sawdust or chips, as an alternative to moisture content, the desired characteristic or parameter of the dry biomass material produced by the dryer may relate to a desired density or a desired friability (or compressed state) of the dry biomass material. These are only a few of the characteristics and parameters that may be of interest and for which control of the compression provided by variable compression nozzle 44 can be adjusted. It will therefore be understood that other parameters can be controlled by adjusting the extent of the compression of the biomass material effected by variable compression nozzle 44, simply by rotating compression adjustor 52.

The characteristics of the dried biomass material or of the wet biomass material can also be a basis for determining the extent of the compression applied to the materials. For example the following characteristics can affect the compression applied: an initial moisture content of the wet biomass material that enters the inlet of the elongate housing; a size of particulates comprising the wet biomass material entering the inlet of the elongate housing; a desired moisture content of the dried biomass material exiting the outlet of the elongate housing; one or more characteristics of a specific type of the wet biomass material that is to be dried with the apparatus; and, a desired temperature range for the dried biomass material exiting the outlet.

Details of Exemplary Variable Compression Nozzle

As shown in the exploded view of FIG. 7, an annular ring 90 disposed at the proximal end of variable compression nozzle 44 is attached by a plurality of threaded fasteners 46 (machine bolts and mating nuts) to arcuate flanges 92 and 94, which are respectively welded or otherwise attached to the distal ends of upper housing 40 and lower bore portion 56 of lower housing 38. Annular ring 90 includes a central round opening (not specifically indicated by a reference number) having a size that matches that of the bore formed in the housing. A plurality of circumferentially spaced-apart struts 84 are welded (or otherwise attached) to the other side of annular ring 90 and extend distally and outwardly to attach to the proximal face of an annular ring 64. A rotatable ring 66 is disposed within annular ring 64 and is rotated when the compression provided by the compression nozzle is being changed.

Figure 9:
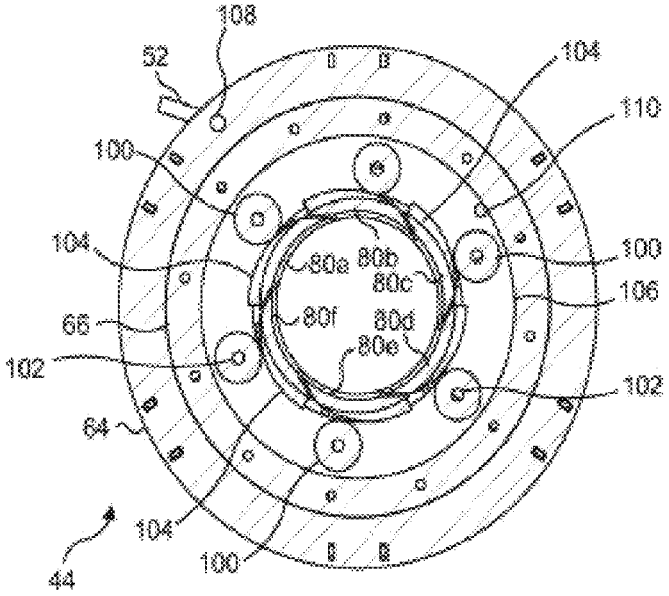
FIG. 9 is a cross-sectional view of the variable compression adjustment assembly, taken along section lines 9-9 of FIG. 8.
Figure 10:
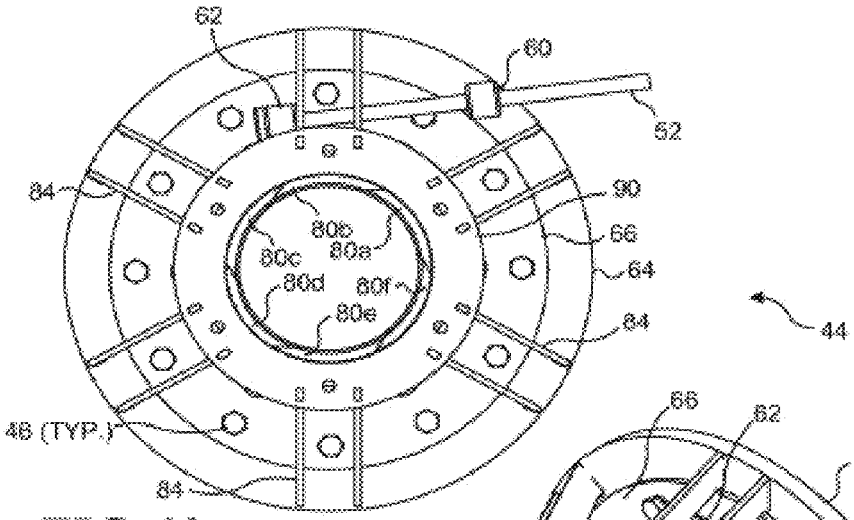
FIG. 10 is an elevational view of an inlet end of the variable compression nozzle.
Figure 11:
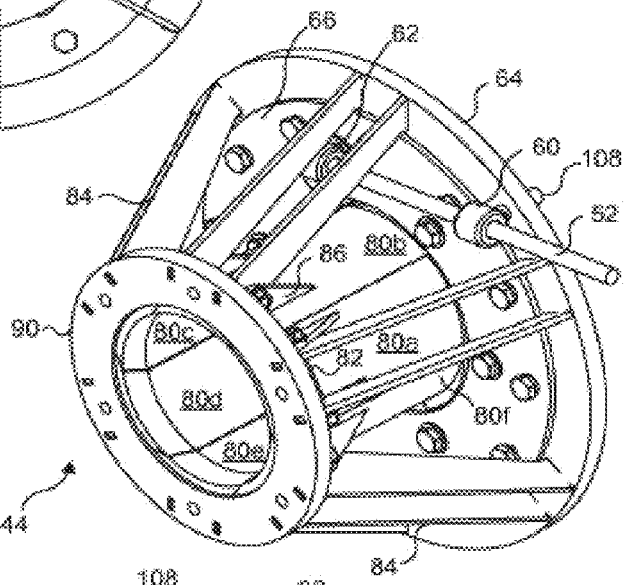
FIG. 11 is an isometric view of the variable compression nozzle.
Figure 12:
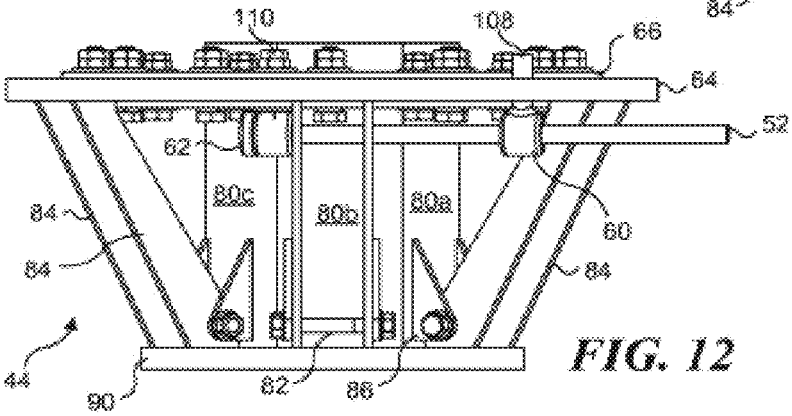
FIG. 12 is a top plan view of the variable compression nozzle.

FIGS. 8-12 are particularly helpful in understanding the configuration and operation of compression nozzle 44. The compression nozzle includes eight segments 80*a*-80*f* that each includes two longitudinally extending tabs 86 attached to their outer surface and adjacent to annular ring 90. Each of a plurality of threaded fasteners 82 extend through orifices formed in the tabs and in strut 84, so that the proximal ends of segments 80*a*-80*f* are pivotally attached to and supported by the struts. The longitudinally extending edges of adjacent segments 80*a*-80*f* overlap, generally as shown in FIG. 10.

The cross-sectional view shown in FIG. 9 will make clear how a plurality of circumferentially spaced-apart rotatable wheels 100 are mounted on axles 102 that are attached to an inner annular ring 106, which is free to rotate about the bore defined between segments 80*a*-80*f*, along with rotatable ring 66, which retains the inner annular ring. A pin 110 that engages inner annular ring 106 extends from a captive bearing mount 62 through an orifice in rotatable ring 66. The distal end of compression adjustor 52 is captured within captive bearing mount 62, but is free to rotate within it. Compression adjustor 52 is threaded along at least a portion of its length and its threads engage a threaded ring 60 that is mounted on annular ring 64 by a pin 108 (also see FIG. 10 to understand the disposition of compression adjustor 52, captive bearing mount 62, and threaded ring 60). Rotation of compression adjustor 52, which acts as a jackscrew, varies the distance between captive bearing mount 62 and threaded ring 60, causing rotation of inner annular ring 106 about the central bore of variable compression nozzle 44. However, wheels 100 roll along ramps 104, so that as the wheels roll up the ramps, an inner surface of each ramp is forced against an outer surface of an adjacent one of segments 80*a*-80*f*, displacing the inner surface of the distal end of the segment radially inward and closer to the end of the auger shaft. This inward displacement of the segments increases the compression of the biomass material passing through the bore of the rotary biomass dryer where more closely spaced-apart helical threads 70*b* are disposed, increasing the extent to which moisture is forced from the biomass material and increasing the frictional force that heats the biomass material. Conversely, if inner annular ring 106 is rotated in the opposite direction, in response to the compression adjustor being turned in the opposite direction, wheels 100 roll down ramps 104, and segments 80*a*-80*f* are allowed to expand radially outward, decreasing the compression applied to the biomass material and reducing the extent to which moisture is forced from and evaporated to dry the biomass material.

The adjustment of compression adjustor 52 can be carried out manually by simply providing an appropriate end on the compression adjustor that can be engaged by a rotatable tool, such as a square or hex shaped end that is engaged by a wrench or socket and then using the tool to rotate the compression adjustor in the direction appropriate to achieve a desired increase or decrease of the compression provided by variable compression nozzle 44. A power rotary drive tool, such as a power drill, might also be used for this purpose. It should also be understood that other mechanisms for adjusting or varying the amount of compression applied to the biomass material being conveyed through the rotary biomass dryer can alternatively be used. One such alternative mechanism is discussed below.

Automated Compression Control

Figure 13:
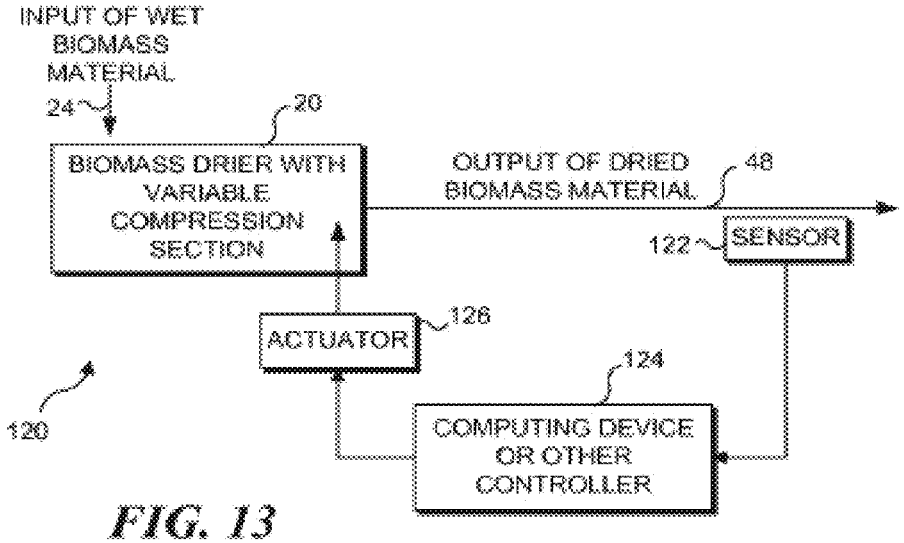
FIG. 13 is a schematic block diagram illustrating the components of an automatically controlled system for controlling the compression of the biomass material moving through the biomass dryer in response to an input signal from a sensor that is monitoring a parameter, such as the moisture of the dried biomass material.

FIG. 13 illustrates a functional block diagram of an automated compression control system 120 for automatically controlling the compression applied by rotary biomass dryer 20 using variable compression nozzle 44. In this system, a sensor 122 monitors a desired parameter or characteristic of the dried biomass material being output from rotary biomass dryer 20, producing either an analog or digital output signal that is indicative of a level of that parameter or characteristic in the dried biomass material. The output signal from the sensor is input to a computing device or other controller 124. Based upon a comparison the detected level of the parameter or characteristic of the dried biomass material with a desired level that was input, the computing device or other controller produces an output signal that is used to energize an actuator 126 to controllably rotate compression controller 52 in an appropriate direction and to an appropriate extent, to increase or decrease the amount of compression being applied to the biomass material by the rotary biomass dryer, so as to achieve the desired level of the parameter or characteristic of the dried biomass material. The actuator can be a small prime mover, such as an electric motor, stepping motor, hydraulic actuator, or other suitable controllable device designed to rotate the compression controller in an appropriate direction and by an appropriate amount to achieve the level of the parameter or desired characteristic of the dried biomass material. As an alternative to turning the compression controller, it will be evident that the compression controller can simply be pushed/pulled if it is not threaded, so that it slides through a bearing where threaded ring 60 is disposed, and thereby causes the rotation of inner annular ring 106 to vary the compression applied to the biomass material.

Sensor 122 will be selected to detect the level of the desired parameter or characteristic of the dried biomass material. For example, if the parameter being controlled is the moisture content of the dried biomass material, sensor 122 will be a moisture sensor, e.g., a sensor that determines the conductance of the dried biomass material as an indication of its moisture content. If the parameter to be sensed is density, a densitometer can be used for sensor 122. Similarly, any other parameter or characteristic to be controlled will dictate the appropriate type of sensor 122 to be used to monitor the condition of the dried biomass material.

Alternative Manually Adjustable Variable Compression Nozzle

Figure 14:
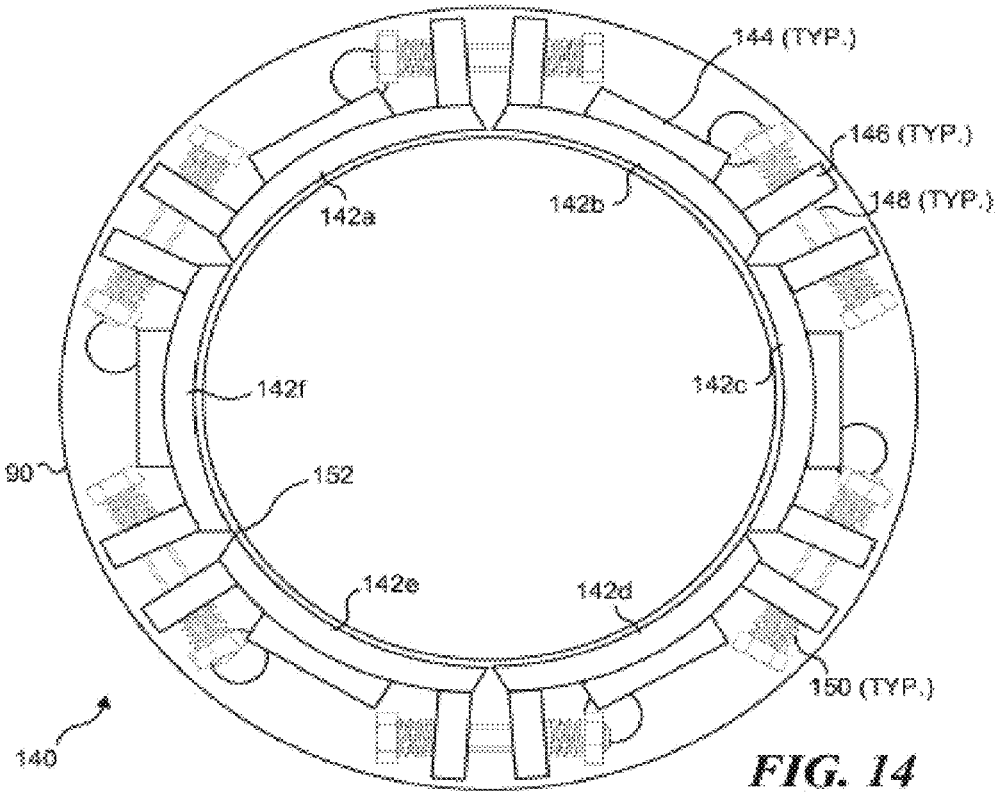
FIG. 14 is an exemplary alternative manual adjustment variable compression nozzle for the rotary biomass dryer.

In FIG. 14, an alternative exemplary embodiment of a manually adjustable variable compression nozzle 140 is illustrated. Variable compression nozzle 140 employs controls at an extent to which the distal ends of a plurality of longitudinally extending segments 142*a*-142*f* are forced radially inward to increase the compression applied to biomass material moving through the distal portion of the bore in rotary biomass dryer 20. Each segment 142*a*-142*f* is about the same length as segments 80*a*-80*f* from variable compression nozzle 44, but includes a stiffener backbone 144 that extends longitudinally (i.e., into the Figure as shown) toward annular ring 90. Edges of adjacent segments 142*a*-142*f* each include outwardly extending tabs 146. Threaded fasteners 148 join the adjacent tabs on adjacent pairs of the segments. Also provided on each end of threaded fasteners 148 are helical coil springs 150. As threaded fasteners 148 are uniformly tightened, they compress helical coil springs 150, applying a force on tabs 146 that draws the edges of the adjacent segments together, tending to reduce gaps 152 that are formed between the edges of each pair of adjacent segments. As gaps 152 are reduced, it will be apparent that the distal ends of segments 142*a*-142*f* are forced radially inward, thereby increasing the amount of compression applied to the biomass material passing through variable compression nozzle 140. Conversely, if the threaded fasteners are all uniformly turned so as to loosen the compression of helical coil springs 150, the force applied by the helical coil springs on tabs 146 is reduced, which allows the segments to move away from the auger shaft and decreases the compression applied to the biomass material.

While it might be possible to apply an automated control of variable compression nozzle 140 using a plurality of actuators that are applied to each threaded fastener 148, such an approach is considered less efficient, compared to the jack-screw type adjustment of variable compression nozzle 44. However, variable compression nozzle 140 is included, since it at least represents an alternative variable compression nozzle, which was in fact used on an earlier exemplary embodiment of the rotary biomass dryer.

Exemplary Computing Device for Controlling Variable Compression Nozzle

Figure 15:
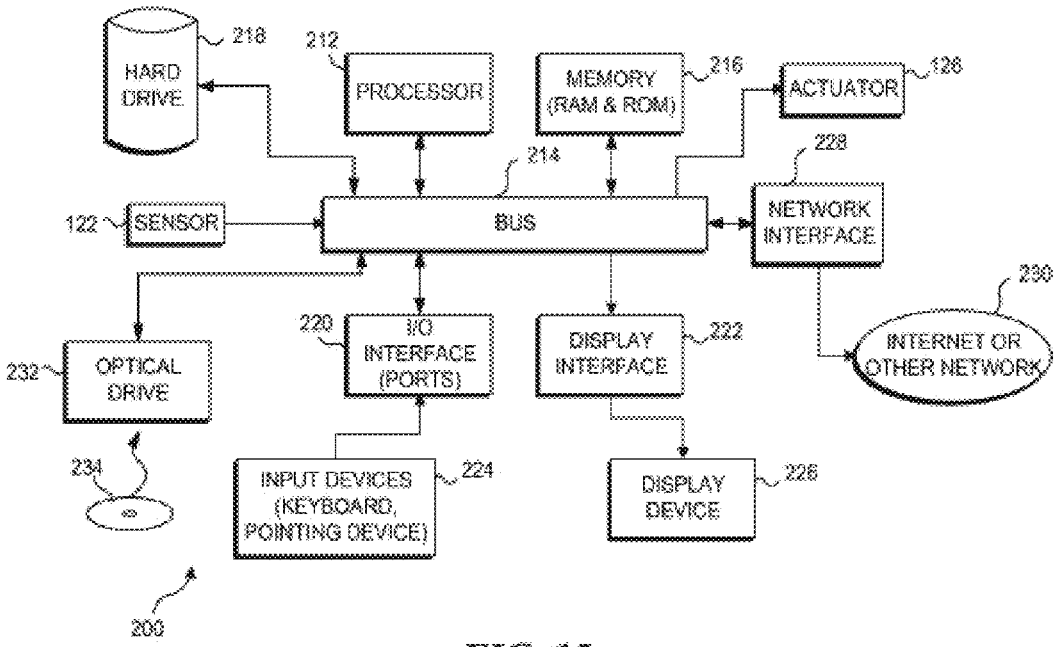
FIG. 15 is a functional block diagram of a computing device (e.g., a personal computer), which is usable for controlling the automatic variable compression nozzle of the rotary biomass dryer.

FIG. 15 illustrates details of a functional block diagram for a computing device 200. The computing device can be a typical personal computer, but can take other forms in which a logic or hardwired device carries the automated control of the variable compression nozzle to achieve a desired parameter, such as a desired moisture content of the dried biomass material that is produced by the exemplary rotary biomass dryer discussed above, in response to an input signal from sensor 122. In this exemplary computing device, a processor 212 is employed for executing machine instructions that are stored in a memory 216. The machine instructions may be transferred to memory 216 from a data store 218 over a generally conventional bus 214, or may be provided on some other form of memory media, such as a digital versatile disk (DVD), a compact disk read only memory (CD-ROM), or other non-volatile memory device. An example of such a memory medium is illustrated by a CD-ROM 234. Processor 212, memory 216, and data store 218, which may be one or more hard drive disks or other non-volatile memory, are all connected in communication with each other via bus 214. The machine instructions control processor 212 so that it responds to a signal input from sensor 122 and adjusts the variable compression nozzle as necessary to either increase or decrease the extent of compression applied to the biomass material that is output from rotary biomass dryer 28. The machine instructions in the memory are readable by the processor and executed by it to carry out the variable compression nozzle control function and other functions that may be useful in automating the process, such as controlling the conveyors providing the wet biomass material to the input of the biomass dryer and conveying the dry biomass material from the outlet of the variable compression nozzle. Also connected to the bus may be a network interface 228 that can be coupled to the Internet or another network 230, an input/output interface 220 (which may include one or more data ports such as any of a serial port, a universal serial bus (USB) port, a Firewire (IEEE 1394) port, a parallel port, a personal system/2 (PS/2) port, etc.), and a display interface or adaptor 222. Anyone or more of a number of different input devices 224 such as a keyboard, mouse or other pointing device, trackball, touch screen input, etc., are connected to I/O interface 220. A monitor or other display device 226 is coupled to display interface 222, so that a user can view graphics and text produced by the computing system as a result of executing the machine instructions, both in regard to an operating system and any applications being executed by the computing system, enabling a user to interact with the system. An optical drive 232 is included for reading (and optionally writing to) CD-ROM 234, or some other form of optical memory medium.

As noted above, the input signal from sensor 122 can be a digital signal or an analog signal indicating the state of the biomass material that is output from the rotary biomass dryer. If an analog signal is produced by the sensor, it may be necessary to convert the analog level to a digital value, so that the processor can determine if the current value of the parameter, such as the moisture content in the dried biomass material is less than or greater than a desired value. If the biomass material that leaves the outlet is too wet, the processor can produce a control signal that controls actuator 126, causing it to increase the level of compression applied by the variable compression nozzle, and conversely, if drier than necessary, can reduce the level of compression using the actuator. A different type of sensor 122 can be employed to detect other parameters of the dried biomass material, such as its density, friability, etc., which can be controlled to achieve a desired value by the processor automatically adjusting the degree of compression of the biomass material applied by the variable compression nozzle.

Although the concepts disclosed herein have been described in connection with the preferred form of practicing them and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

The invention in which an exclusive right is claimed is defined by the following:

1. An apparatus for reducing a moisture content of a biomass material that is relatively wet, comprising:

(a) a prime mover;

(b) an elongate housing extending between a proximal end and a distal end, said housing having an inlet disposed adjacent to the proximal end for receiving the relatively wet biomass material and an outlet disposed adjacent to the distal end, through which the biomass material passes after being dried to a substantially lower moisture content; and (c) a generally helical screw shaft disposed within the elongate housing and drivingly coupled to the prime mover so as to be rotated thereby about a longitudinal axis of said shaft, in a direction selected so that helical screw threads formed on said shaft force the biomass material entering through the inlet to move through the housing, toward the distal end, and then out through the outlet of the housing, wherein the biomass material is compressed as it moves through the elongate housing, forcing moisture from the biomass material, friction resulting from the compression and movement of the biomass material through the housing also heating the biomass material to drive out much of the moisture remaining in the biomass material.

2. The apparatus of claim 1, wherein the elongate housing includes an adjustable section disposed adjacent to the distal end, the adjustable section including a plurality of circumferentially adjacent segments around the helical screw shaft that together form a generally cylindrical shaped bore with an internal diameter that can be adjusted at the distal end of the elongate housing, the annular clearance between an interior surface of each segment and the helical screw shaft being adjustable by forcing the segments to move radially inwardly or outwardly at the distal end of the housing, thereby varying the internal diameter of the cylindrical shape formed thereby, so that an extent to which the biomass material is compressed as it moves through the adjustable section is variable to achieve a desired moisture content in the biomass material exiting through the outlet.

3. The apparatus of claim 2, wherein the adjustable section includes a jackscrew that extends between a fixed member and a rotatable ring that extends around the segments, the rotatable ring including a plurality of spaced-apart rotatable wheels that roll on ramps to apply a radial force against the segments that varies as the wheels roll up or down the ramps, depending on a direction in which the jackscrew is rotated, the varying radial force varying the internal diameter of the cylindrical shape formed by the segments.

4. The apparatus of claim 2, wherein each of the segments includes tabs extending radially outward and running longitudinally along opposite edges of the segment, adjacent to distal ends thereof, threaded fasteners coupling the tabs on adjacent sections together and being manually tightened or loosened to achieve a desired radial compression of the plurality of segments to variably adjust an internal diameter of a cylindrical bore defined by the segments.

5. The apparatus of claim 4, further comprising helical springs disposed on the threaded fasteners to provide a biasing force to radially compress the segments as the threaded fasteners are tightened.

6. The apparatus of claim 1, wherein the helical screw shaft includes a distal portion having threads that are finer and more closely spaced than threads provided on a proximal portion.

7. The apparatus of claim 1, wherein the helical screw shaft includes helical threads of varying width over at least a portion of its length.

8. The apparatus of claim 1, wherein the helical screw shaft includes helical threads of differing densities along its length.

9. The apparatus of claim 1, wherein the helical screw shaft is directly coupled to a drive shaft of the prime mover, and wherein the prime mover and elongate housing are mounted on a portable base to enable the apparatus to be portable and readily movable to a site where the apparatus is to be used for drying the wet biomass material.

10. The apparatus of claim 1, further comprising means for adjusting an extent to which the biomass material is compressed before it exits through the outlet, in consideration of at least one characteristic selected from the group of characteristics consisting of:

(a) an initial moisture content of the wet biomass material that enters the inlet of the elongate housing;

(b) a size of particulates comprising the wet biomass material entering the inlet of the elongate housing;

(c) a desired moisture content of the biomass material exiting the outlet of the elongate housing;

(d) one or more characteristics of a specific type of the wet biomass material that is to be dried with the apparatus; and (e) a desired temperature range for the biomass material exiting the outlet of the elongate housing.

11. The apparatus of claim 10, wherein the means for adjusting are disposed adjacent to the distal end of the elongate housing and includes a plurality of longitudinally extending segments that are circumferentially disposed around the helical screw shaft, wherein the means for adjusting includes means for varying a radial force applied against the segments so as to vary a gap defined between the segments and the helical screw shaft.

12. The apparatus of claim 1, wherein the inlet is configured and the prime mover is operated so as to enable a continuous processing of a stream of the wet biomass material, to dry the stream of the wet biomass material, so long as the wet biomass material is continually supplied through the input.

13. The Apparatus of claim 1, wherein the frictional heating and compression of the wet biomass material as it moves through the housing uses mechanical energy supplied by the rotating shaft to drive out much of the moisture remaining in the biomass material without requiring heating from any external heat source.

14. An apparatus for reducing a moisture content of a biomass material, comprising:

(a) a prime mover; and (b) a mechanical compression device that is coupled to the prime mover and driven by it, the mechanical compression device including an inlet for receiving the biomass material and an outlet through which the biomass material that has been dried passes after being conveyed through the compression device, the mechanical compression device being configured for compressing the biomass material to remove moisture and for heating the biomass material using friction resulting from movement of the biomass material through the compression device, wherein the heating of the biomass material due to the friction further dries the biomass material by vaporizing much of the moisture remaining in the biomass material to substantially reduce its moisture content, without requiring heating by an external source of heat.

15. The apparatus of claim 14, wherein the mechanical compression device includes an auger having a shaft with helical threads, the shaft being rotatably coupled to the prime mover and rotated thereby in a direction selected to use the helical threads to move the biomass material through the compression device from the inlet to the outlet.

16. The apparatus of claim 15, wherein the helical threads have different thicknesses at different longitudinal positions along the shaft, for compressing the biomass material as the rotating auger moves the biomass material through the mechanical compression device.

17. The apparatus of claim 15, wherein a density of the helical threads is different at different longitudinal positions along the shaft.

18. The apparatus of claim 14, wherein the compression device includes a distal section disposed adjacent to the output that is configured to enable adjustment of the compression applied to the biomass material.

19. The apparatus of claim 18, wherein the distal section includes a plurality of longitudinally extending segments disposed adjacent to each other, and a circumferential yoke having an adjuster that is moved to control a radial compression force applied to the plurality of segments, so as to vary the compression force applied to the biomass material passing through the distal section of the compression device.

20. The apparatus of claim 14, wherein the circumferential yoke includes a plurality of spaced-apart rotatable wheels that interact with adjacent ramps so that as the wheels roll along the ramps in one direction when the yoke is caused to rotate about a central axis of the compression device, a force exerted on the segments by the ramps and the rotatable wheels increases, while when the wheels roll along the ramps in an opposite direction, the force decreases, wherein the force exerted on the ramps determines an extent of a compression of the biomass material.

* * * * *